United States Patent [19]

Avidon

[11] Patent Number: 4,545,536

[45] Date of Patent: Oct. 8, 1985

[54] APPARATUS FOR ELECTROSTATIC PAINT SPRAYING

[76] Inventor: Yakov Avidon, 2600 Park Ave., Apt. 3F, Bridgeport, Conn. 06604

[21] Appl. No.: 494,185

[22] Filed: May 13, 1983

[51] Int. Cl.[4] ..... B05B 5/02

[52] U.S. Cl. ..... 239/695; 239/691; 239/707

[58] Field of Search ..... 239/520, 696, 697, 706, 239/707, 704, 708, 290

[56] References Cited

U.S. PATENT DOCUMENTS

| | | | |
|---|---|---|---|
| 2,784,350 | 3/1957 | Sedlacsik | 239/704 |
| 2,966,310 | 12/1960 | Sedlacsik | 239/697 |
| 3,351,286 | 11/1967 | Tholome | 239/706 |
| 3,408,985 | 11/1968 | Sedlacsik, Jr. | 239/698 X |
| 3,578,997 | 10/1969 | Felici | 239/706 X |
| 3,599,038 | 8/1971 | Skidmore | 317/3 |

FOREIGN PATENT DOCUMENTS

| | | | |
|---|---|---|---|
| 4812 | of 1912 | United Kingdom | 239/520 |
| 2086764 | 11/1980 | United Kingdom | 239/707 |

*Primary Examiner*—Andres Kashnikow
*Assistant Examiner*—Kevin Patrick Weldon
*Attorney, Agent, or Firm*—Parmelee, Bollinger & Bramblett

[57] ABSTRACT

Apparatus is disclosed for spraying electrostatically charged particles of paint toward a workpiece. Increased paint throughput is achieved over prior art devices by employing enlarged paint discharge passages and two different air streams. One air stream, which is adjustable in flow, serves to atomize the paint into substantially uniform, very tiny droplets and the other air stream, which is also adjustable in flow, directs the atomized paint toward the workpiece. Safety is increased by positioning the paint charging electrode within a paint delivery passage located relatively far upstream from the paint nozzle. A second electrode in the nozzle is "floating" in electrical potential and serves to supply additional electrical charge to the very fine paint particles as they issue from the nozzle. In this manner, the impedance of the paint itself and the "floating" electrode serve to reduce the risk of sparking between the paint spraying apparatus and the workpiece.

7 Claims, 9 Drawing Figures

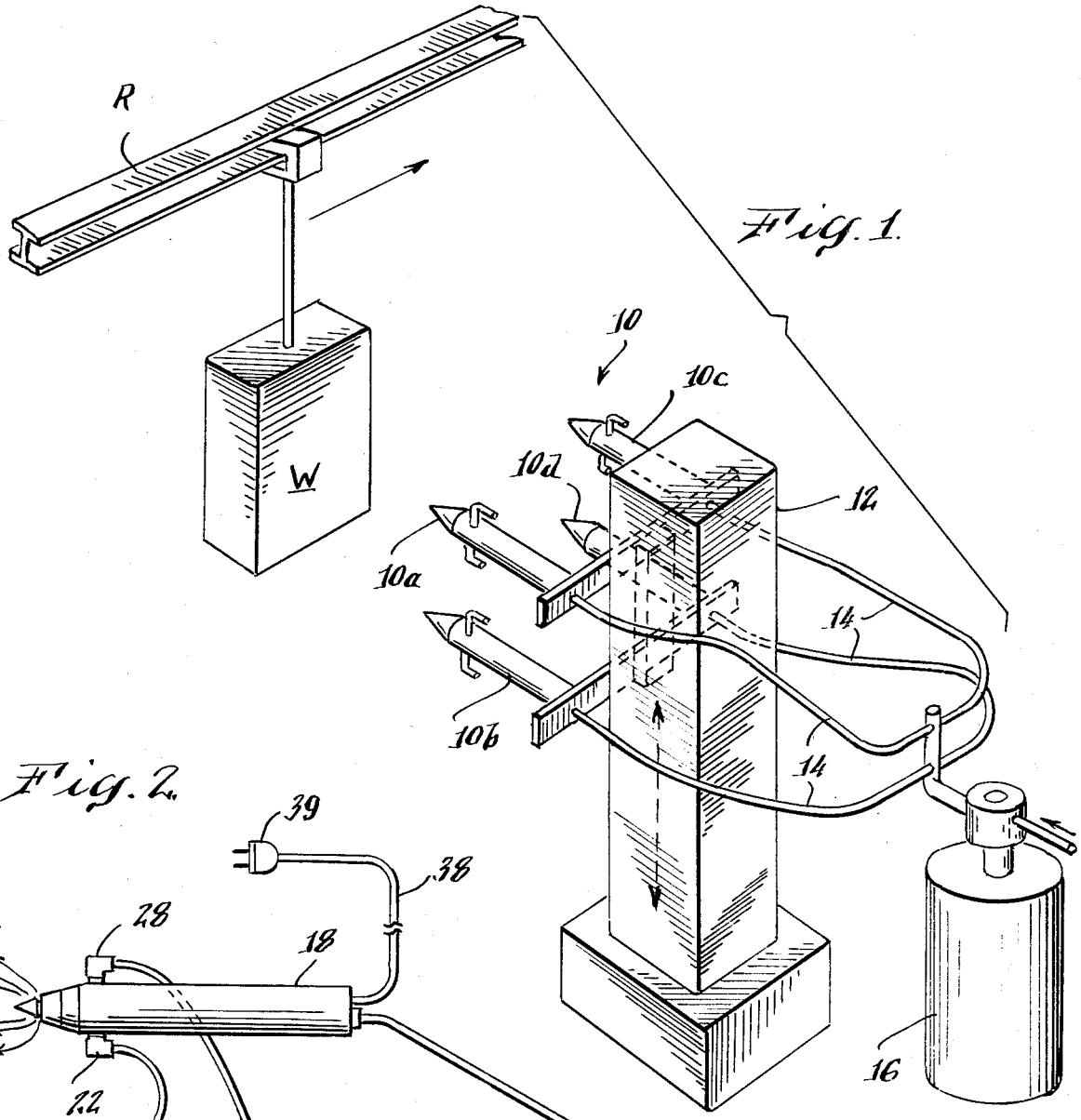
Fig. 1.
Fig. 2.
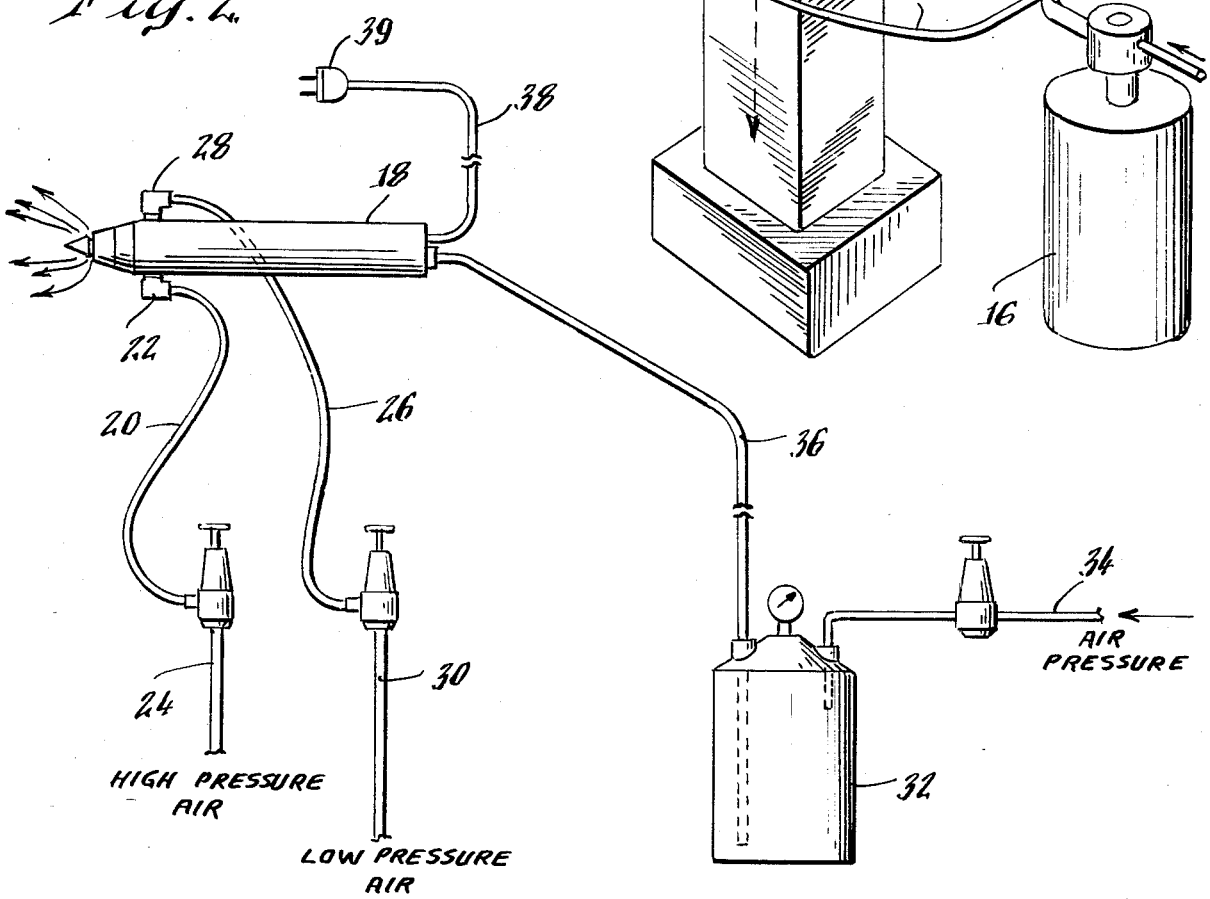

APPARATUS FOR ELECTROSTATIC PAINT SPRAYING

BACKGROUND OF THE INVENTION

The painting of workpieces by spraying with electrostatically charged paint particles is well known in the art. The technique is widely used due to its many advantages. For example, paint waste is drastically reduced, because the charged paint particles are attracted to the workpiece. This electrostatic attraction also insures a more uniformly coated workpiece and also assists in coating hard-to-reach portions of the workpiece.

In spite of its advantages, the prior art apparatus is not without its drawbacks. One such drawback arises from the fact that the paint is atomized by being expelled at relatively high pressure through small orifices. These small orifices, while serving to atomize the paint, also restrict the throughput (pounds of paint per minute) of the apparatus.

Another disadvantage arises from the high potential gradient that exists between the electrode in the nozzle of prior paint spraying apparatus and the workpiece. If the nozzle of a prior paint sprayer approaches the workpiece too closely, sparking between the grounded workpiece and the nozzle may result, which creates a fire hazard in the paint-laden atmosphere.

Accordingly, primary objects of this invention are to increase the paint throughput of such paint spraying apparatus and to substantially eliminate the dangers of sparking between the paint sprayer and the workpiece. Other objects, features, and advantages will become understood from the following description in conjunction with the drawings and appended claims.

SUMMARY OF THE INVENTION

In accordance with the present invention, there is provided an apparatus for spraying a workpiece with electrostatically charged liquid droplets. The apparatus includes a body member which defines an elongated delivery passage having a liquid input end and a liquid discharge end and a plurality of discharge passages which extend from the discharge end of the delivery passage to the exterior of the body member. A high voltage electrode is positioned adjacent the input end of this delivery passage in electrical contact with liquid which is flowing therethrough. Means are provided for directing a first adjustable gas stream against liquid issuing from the discharge passages to atomize the liquid into substantially uniform, very fine droplets. Other means are provided for directing a second gas stream against the atomized droplets to propel them toward the workpiece.

BRIEF DESCRIPTION OF THE DRAWINGS

FIG. 1 is a perspective view of an electrostatic paint spraying setup as it might be found in an industrial plant;

FIG. 2 illustrates a single paint spraying apparatus and the connections thereto;

DESCRIPTION OF THE PREFERRED EMBODIMENT

Figure 3:
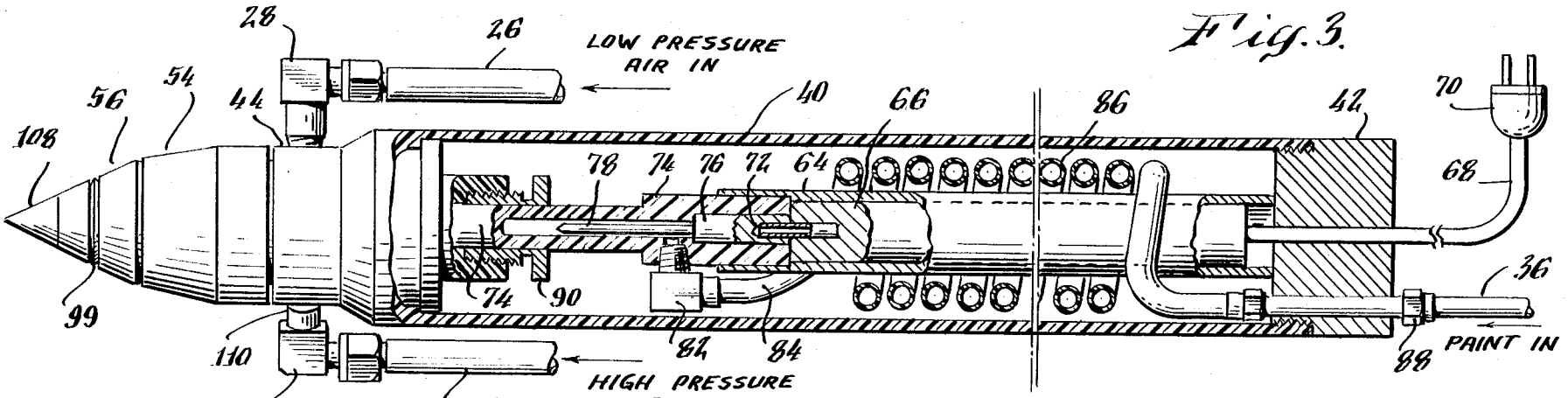
FIG. 3 is an elevational view, partially in cross-section, of a paint spraying apparatus in accordance with the invention.

With particular reference to FIG. 1, there is illustrated a paint spray station array 10 of paint spray guns 10*a*–10*d* on a common mount for vertically reciprocating motion along a pedestal 12. Hoses 14 connect the individual guns to a common paint reservoir 16. A workpiece W is suspended from a rail R for horizontal travel therealong past the array 10.

FIG. 2 illustrates in more detail the connections that are made to a representative single spray gun 18. These connections include a hose 20 and fitting 22 for connection to a high pressure source of primary air 24. A similar hose 26 and fitting 28 provide a connection to a low pressure source of secondary air 30. A paint supply reservoir 32, pressurized from an air source 34, is connected to the gun by means of a hose 36. Finally, the gun 18 is connected to a conventional alternating current electrical power source by means of an electrical cord 38 and a plug 39.

Figure 4:
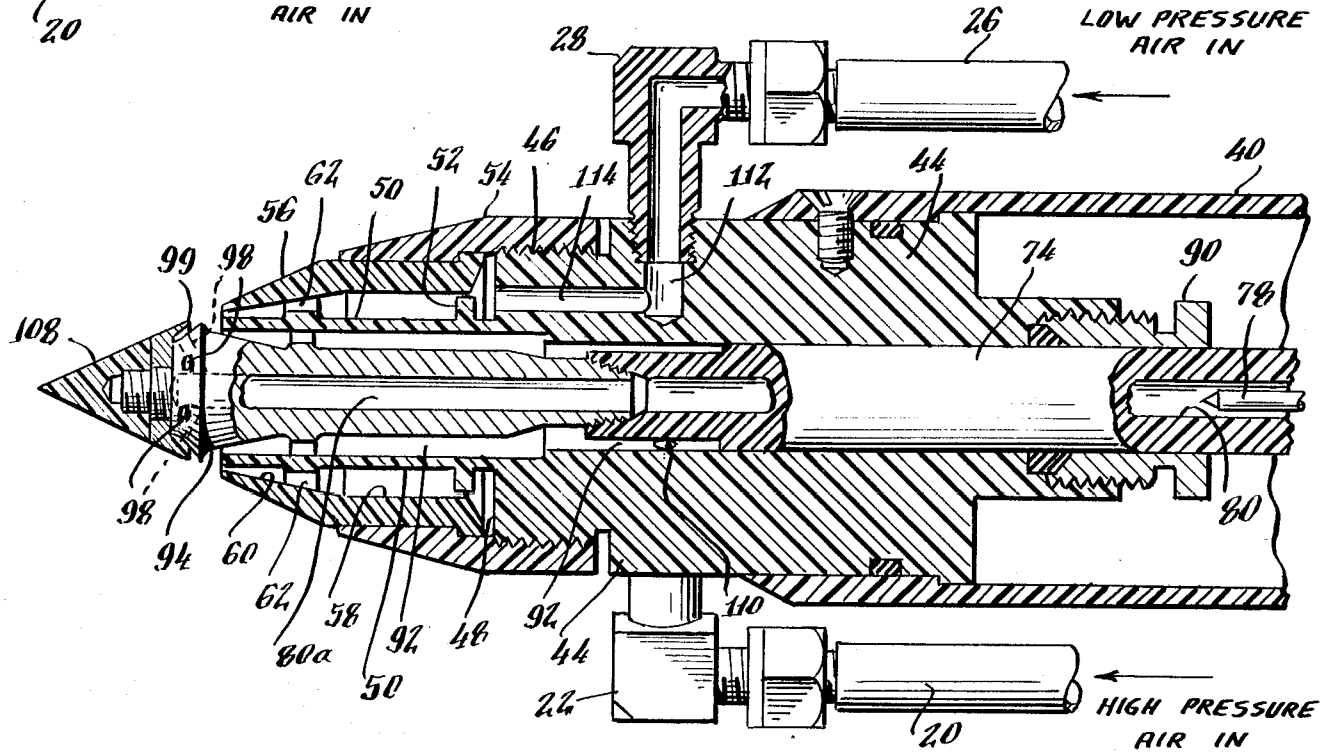
FIG. 4 is an enlarged cross-sectional view of a portion of the apparatus of FIG. 3.
Figure 5:
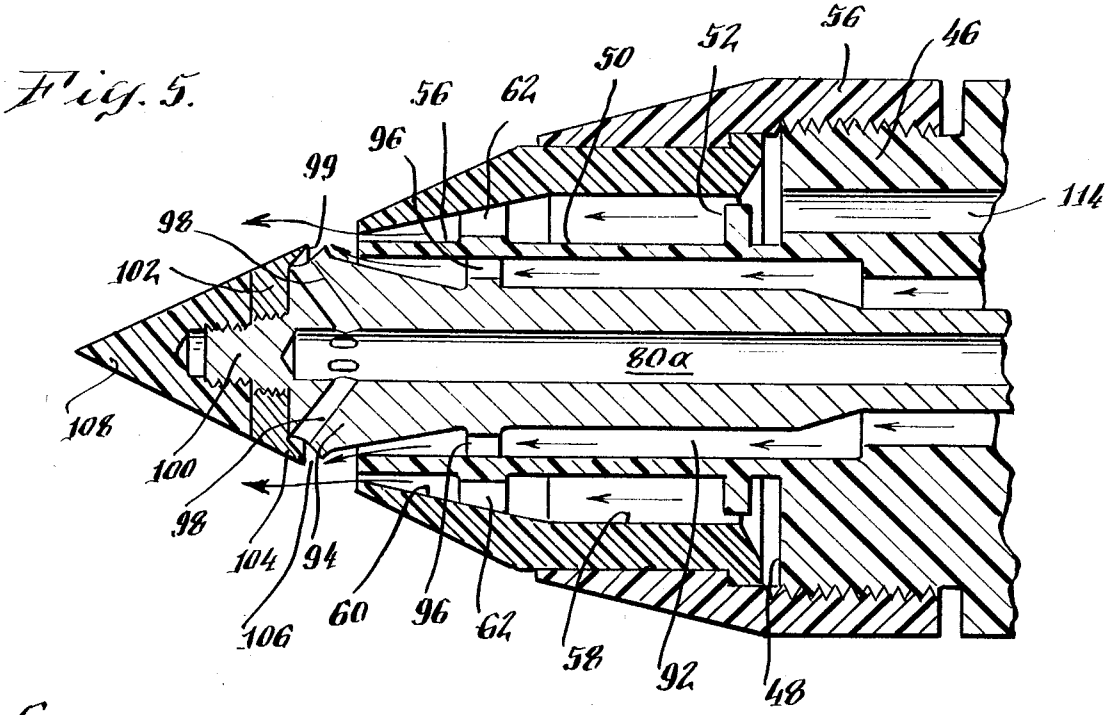
FIG. 5 is a further enlarged cross-sectional view of the tip portion of the apparatus of FIGS. 3 and 4.

FIGS. 3–5 illustrate in detail the construction of a spray gun in accordance with this invention. The spray gun comprises a substantially cylindrical housing 40 of electrically insulating material, for example rigid plastic material, closed at one end by a base plug 42 and at the other by a nose piece 44 formed of rigid electrically insulating material. Nose piece 44 is substantially cylindrical and, forwardly of the end of housing 40, includes a reduced diameter threaded portion 46 (FIG. 4). Threaded portion 46 terminates at a substantially flat face 48 from which extends a further reduced portion 50 carrying a circumferential rib 52 spaced from the face 48.

A locking ring 54 includes a cylindrical portion which is threaded onto the threaded portion 46 of nose piece 44 to thereby secure a nozzle member 56. Nozzle member 56 defines an internal cylindrical surface 58 adjacent a frustoconical surface 60 which encircles the portion 50 of nose piece 44 and is spaced therefrom. Mounted in the annular space between the portion 50 and the nozzle member 56 are a plurality of radial, helically disposed, swirl vanes 62.

Referring now to FIG. 3, it will be noted that, extending forwardly from the base plug 42, is a cylindrical tube 64. Mounted within the tube 64 is an electrical assembly 66. Assembly 66 is not illustrated in detail. However, it may be connected by means of a cord 68 and plug 70 to a conventional electrical power supply. The function of the assembly 66 is to step up and rectify the voltage. Accordingly, it may include such items as a step-up transformer, rectifiers, etc. It may be encapsulated and its output is supplied through a metal contact 72. Extending forwardly from the end of tube 64 is a substantially tubular body member 74 formed of insulating material. Positioned within the member 74 and in electrical contact with the contact 72 is a conductive member 76 including a sharpened pin-like electrode 78 within the passage 80 of body member 74.

A radial passage extends through the body member 74 and into the passage 80 adjacent the electrode 78 and into it is screwed a tube fitting 82. A tube 84 of insulating material is connected to fitting 82 and is wrapped around the tube 64 to form a coil 86. The end of the tube 84 extends through the base plug 42 to a connector 88 which is connected to the paint supply hose 36. The forward end of body member 74 extends axially through the nose piece 44 where it is secured by means of a threaded locking nut 90 as illustrated in FIG. 4. At its forward end, the body member 74 has a reduced diameter to thereby form an annular passage 92. The forward end of the body member 74 is also flared and internally threaded to receive the rear end of an elongated metal nozzle member 94.

As will be most apparent from FIG. 5, the nozzle 94 is formed of metal of good electrical conductivity and comprises an electrode which "floats" in potential as will be explained more fully in connection with FIG. 6. This electrode nozzle member 94 includes a central passage 80*a* which is a continuation of passage 80. Externally it forms the annular passageway 92 with the inner wall of the reduced portion 50 of nose piece 44 and a plurality of radial, helically arranged, swirl vanes 96 are mounted therein in a fashion similar to swirl vanes 62. As will also be apparent from FIG. 5, the forward end of nozzle 94 tapers outwardly so that the cross-sectional area of the passage downstream of the swirl vanes 96 is substantially reduced. The forward end of the nozzle 94 is drilled so as to define a plurality of radial, inwardly directed, discharge passages 98. In the illustrated embodiment, there are six such passages. The outer surface of the nozzle 94 describes a reversed conical taper and its forward end forms a dual diameter threaded stud 100. Threaded onto the stud 100 is an annular electrically conductive metal paint guide 102 which has a rearwardly extending skirt 104 which forms, together with the tapered forward edge of nozzle member 94, an annular passage 106. Threadedly secured to the smaller diameter portion of threaded stud 100 is a conical insulator tip 108.

Returning to FIG. 4, it will be noted that a radial passage 110 is drilled through the side of nose piece 44 and into the passage 92. The fitting 22 connects to the passage 110 and to the hose 20 connected to the relatively high pressure primary air source 24. Another radial passage 112 extends into the nose piece 44 and meets with a horizontal passage 114 which passes into the annular space forward of the front face 48 of the nose piece 44. Connected into the passage 112 is the fitting 28 to which is secured the hose 26 connected to the relatively low pressure secondary air source 30.

OPERATION

Mechanical

The paint reservoir 32 is normally under positive pressure from air source 34. Accordingly, paint is caused to flow through the hose 36 and coil 86 into the passages 80, 80*a*. At the forward end of the nozzle 94, the paint flows outwardly through discharge passages 98 into the annular passage 106. Atomization of the paint into very fine, uniformly atomized particles is provided by the primary air source as will be explained. Accordingly, the passages 98 may be larger than in prior art paint spraying devices and the paint throughput, accordingly, is substantially increased over that of prior art devices.

Paint atomization is achieved by means of the high pressure air from hose 20 which enters the nose piece 44 through passage 110 and travels along the annular passage 92 through the swirl vanes 96. The vanes 96 impart rotation to the air stream and its velocity is increased by the narrowing passage which it exits as shown by the arrows in FIG. 5. It exits adjacent the paint discharge passage 106 and this swirling high velocity air stream atomizes the paint into the desired droplets.

The atomized droplets are propelled in the direction of the workpiece by means of the relatively low pressure air stream from hose 26 which passes into the nose piece 44 through passages 112, 114. This air enters the annular space immediately forward of the face 48 of the nose piece where it is relatively evenly distributed by virtue of the throttling effect of the annular rib 52. The air passes evenly around the circumference of this annular rib and passes through another set of swirl vanes 62 and exits as shown by the arrows in FIG. 5.

Figure 7:
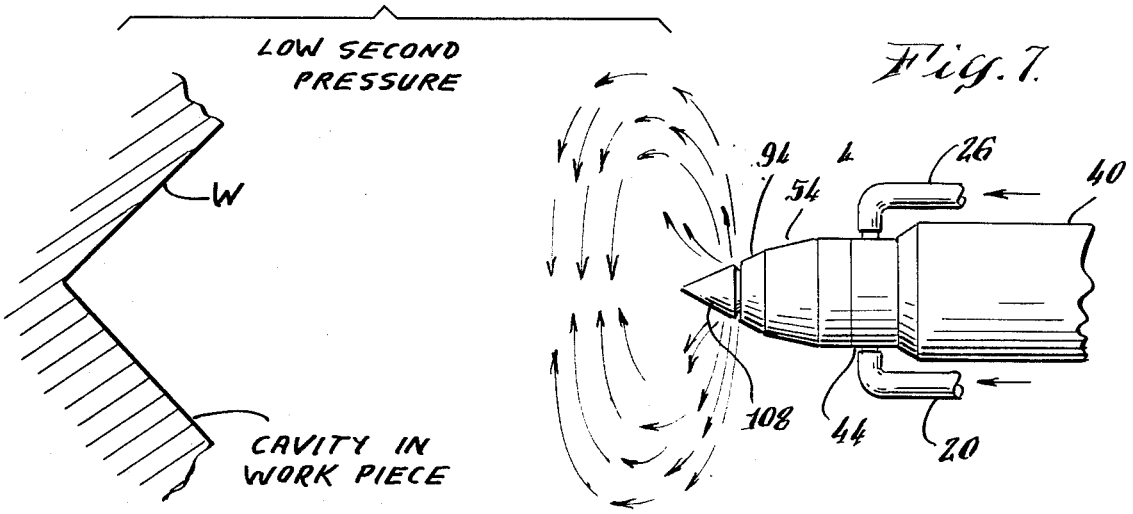
FIGS. 7–9 are illustrations showing the effect of varying the flow of the secondary air supply.
Figure 8:
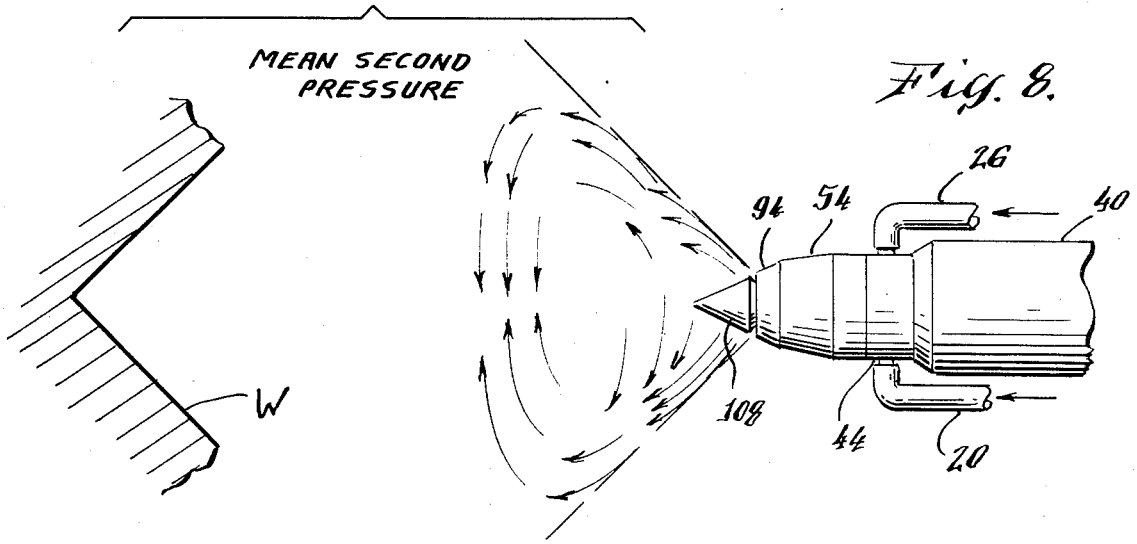
Figure 9:
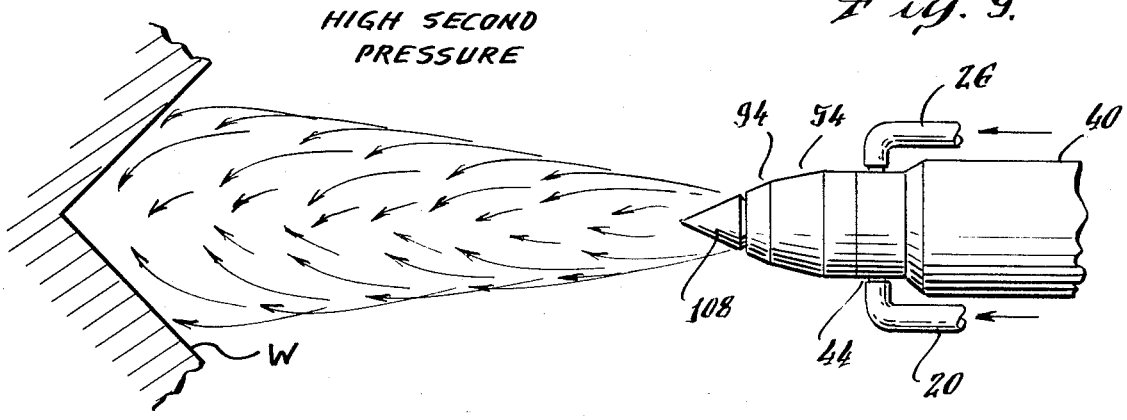

The spray pattern can be altered substantially by simply varying the pressure of the secondary air as shown in FIGS. 7–9. With secondary air at a relatively low pressure, the paint particles tend to disperse rapidly in the vicinity of the nozzle as shown in FIG. 7. However, increasing the pressure of the secondary air causes the particles to be propelled horizontally toward the workpiece. With a relatively high secondary air pressure as shown in FIG. 9, the particles penetrate cavities in the workpiece much more easily.

Electrical

Since this nozzle member 94 is electrically conductive and since it is insulated from the first electrode 78 by the insulating material of the body member 74, this nozzle 94 is "floating" in electrical potential. It assumes an electrical potential which is less than the electrode 78 but which is normally far above ground (earth) potential. Therefore, as the very fine paint droplets are being atomized, they become electrically charged by the sharp annular lip 99 immediately adjacent to the region where this intense atomization is occurring. Consequently, these very fine paint particles are strongly electrically charged as they are being atomized.

Figure 6:
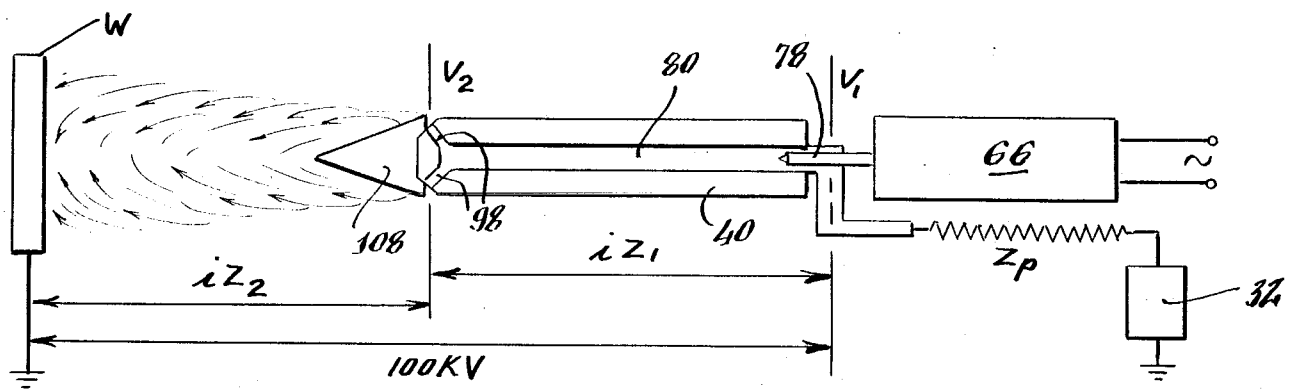
FIG. 6 is a schematic illustration showing the electrical relationship between the apparatus of the invention and the workpiece.

FIG. 6 schematically illustrates the electrical characteristics of the apparatus of this invention. Customarily the voltage between the paint charging electrode 78 and the workpiece W will be on the order of 100–120,000 volts. However, in most prior art devices, the electrode is located at the tip of the gun in close proximity to the emerging paint droplets. In accordance with the present invention, however, the paint charging electrode is located at the upstream end of paint passage 80. This means that the voltage between $V_1$ at the electrode and the workpiece W is divided between two potential drops. The first is a potential drop between $V_1$ and $V_2$ at the tip of the sprayer. This is represented by the current i which flows between electrode 78 and the workpiece W multiplied by the impedance $Z_1$ of the paint within the passage 80. The second is the product of the current i and the impedance $Z_2$ of the cloud of paint droplets between the tip $V_2$ and the workpiece W. The impedance $Z_1$ is relatively high and $V_2$ is floating. Thus, if the tip of the spraying apparatus is moved toward the workpiece W, the impedance $Z_2$ drops substantially but the relatively high impedance $Z_1$ remains unchanged. This means that as the sprayer tip approaches the workpiece W, the voltage $V_2$ also approaches ground. When $V_2$ does, in fact, become ground, the only current that can flow from $V_1$ is limited by the impedance $Z_1$. This is sufficient to prevent sparking and its subsequent fire or explosion hazard.

An additional advantage of the construction of this invention arises from the fact that current leakage to ground through the paint reservoir 32 is substantially eliminated. This is accomplished by means of the coil 86 through which paint is delivered to the spray tip. By making the coil as large as is conveniently possible, the paint itself becomes a relatively high impedance designated in FIG. 6 as $Z_P$. The existence of this impedance prevents any substantial leakage of current from $V_1$ to ground through the paint reservoir 32.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

What is claimed is:

1. A liquid coating spray gun for coating workpieces with electrostatically charged droplets of the liquid, comprising:

a forwardly extending body member of electrically insulating material defining a forwardly extending elongated liquid delivery passage;

said liquid delivery passage having an input end at the rear of said body member connected to a source of the liquid coating and having a front end at the front of said body member;

an electrically conductive nozzle connected to the front end of said insulating body member and having a discharge passage therein receiving liquid flowing forward from the front end of said liquid delivery passage;

first air directing means for directing higher velocity air against liquid issuing from said discharge passage for atomizing said liquid into fine droplets;

second air directing means directing a second flow of lower velocity air against the atomized droplets for propelling them toward the workpiece;

a high voltage electrode positioned near the input end of said liquid delivery passage in contact with the liquid flowing forward in said passage for applying a high potential to the liquid near the input end of said elongated delivery passage;

said conductive nozzle being electrically insulated from said high voltage electrode by said insulating body member;

said conductive nozzle at an electrical potential lower than the potential of said electrode for reducing the hazard of sparking occurring when a workpiece and the nozzle are positioned relatively close to each other; and said conductive nozzle having a sharp pointed surface near the liquid issuing from said discharge orifice for electrically charging the droplets being atomized by said higher velocity air.

2. Apparatus for spraying a workpiece with electrostatically charged liquid droplets which comprises:

a body member of electrically insulating material defining therethrough an elongated delivery passage having a liquid input end and a liquid discharge end and a plurality of discharge passages extending from the discharge end of said delivery passage to the exterior of said body member;

said body member including an electrically conductive portion at said discharge end of said elongated delivery passage;

said plurality of discharge passages being located in said conductive portion;

a high voltage electrode near the input end of said delivery passage in electrical contact with liquid flowing therethrough for applying an electrical potential to the liquid near the input end of said elongated delivery passage;

said conductive portion being insulated from said high voltage electrode by said body member for assuming an electrical potential less that that of said electrode;

said conductive portion including a sharp-edged rearwardly extending annular lip;

said conductive portion defining an annular channel adjacent to and immediately rearward of said sharp-edged annular lip;

said annular channel being open to the exterior of said apparatus adjacent to said sharp-edged annular lip;

said plurality of discharge passages communicating with said annular channel for feeding liquid from said elongated delivery passage into said annular channel;

first means for directing a first gas stream against liquid issuing from said annular channel adjacent to said sharp-edged annular lip to atomize said liquid into droplets while becoming electrically charged by said sharp-edged annular lip; and second means for directing a second gas stream against the atomized and charged droplets to propel them toward said workpiece.

3. Apparatus for spraying a workpiece with electrostatically charged liquid droplets as claimed in claim 2, in which:

said conductive portion includes a second sharp annular lip positioned adjacent to and immediately rearward of said annular channel, said second sharp annular lip facing radially outward relative to the axis of said elongated delivery passage; and said first means directs said first gas stream to flow in a direction past said second sharp annular lip and across said annular channel where said annular channel is open to the exterior of said apparatus for atomizing the liquid issuing from said annular channel.

4. A liquid spray gun for spraying a workpiece with electrostatically charged fine droplets comprising:

an elongated hollow cylindrical barrel of electrically insulating material having a base and a front end;

an elongated insulating body member mounted within said barrel and extending axially of the barrel toward the front end;

said body member defining a liquid delivery passage extending in an axial direction therein, said delivery passage having an input end nearer the base of the barrel and having an output end nearer the front of the barrel;

an elongated conductive nozzle positioned at the front end of the barrel and being connected to said insulating body member;

said conductive nozzle having an output passage communicating with the output end of said liquid delivery passage in said insulating body member and forming a forward continuation of said delivery passage;

said conductive nozzle having an annular discharge opening encircling the nozzle near its front end;

said conductive nozzle having a sharp lip encircling the nozzle adjacent to said annular discharge opening and being positioned immediately forward thereof;

said conductive nozzle having a plurality of discharge passages extending outwardly from said output passage to said annular discharge opening for feeding liquid thereto for spraying the liquid;

a tube of insulating material positioned within said barrel for connection at its back end near the base of the barrel to a source of the liquid to be sprayed;

said tube extending forwardly within the barrel and being coiled within said barrel for providing a significant length of said tube within the barrel for providing a high electrical impedance through the length of liquid therein;

said tube being connected at its front end to the input end of said delivery passage in said insulating body member for feeding liquid into said delivery passage;

a high voltage electrode near the input end of said delivery passage in contact with the liquid therein;

said conductive nozzle being insulated from said high voltage electrode by said insulating body member for assuming an electrical potential less than that of said electrode;

first air delivery means near said conductive nozzle for directing pressurized air at higher velocity against the liquid issuing from said annular discharge opening for atomizing said liquid into fine droplets while the droplets become electrically charged by said sharp lip; and second air delivery means for directing lower velocity air against the newly atomized and charged droplets for propelling them forward toward the workpiece.

5. A liquid spray gun for spraying a workpiece with electrostatically charged fine droplets as claimed in claim 4, in which:

said output passage is centrally located in said conductive nozzle;

said plurality of discharge passages radiate from said output passage being directed forwardly and outwardly from said output passage;

said sharp lip forms a sharp-edged annular skirt forward of said annular discharge opening; and said sharp-edged annular skirt is inclined rearwardly.

6. A liquid spray gun for spraying a workpiece with electrostatically charged fine droplets as claimed in claim 5, in which:

said first air delivery means is positioned rearward of said annular discharge opening and is directed forwardly toward said sharp-edged skirt directing the higher velocity air across said annular discharge opening toward said sharp-edged skirt.

7. A liquid spray gun for spraying a workpiece with electrostatically charged fine droplets as claimed in claim 6, in which:

said conductive nozzle has an annular lip encircling the nozzle between said first air delivery means and said annular discharge opening.

* * * * *